United States Patent [19]

Koo

[11] 3,945,136

[45] Mar. 23, 1976

[54] SPRING LIFT FOR SHOES

[76] Inventor: Bonny B. Koo, P.O. Box 503, Pacific Grove, Calif. 93950

[22] Filed: Feb. 10, 1975

[21] Appl. No.: 548,381

[52] U.S. Cl. ..... 36/38
[51] Int. Cl.[2] ..... A43B 21/30
[58] Field of Search ..... 36/38, 7.8, 7.6, 35

[56] References Cited

UNITED STATES PATENTS

| | | | |
|---|---|---|---|
| 413,693 | 10/1889 | Walker | 36/7.8 X |
| 500,816 | 7/1893 | Murray | 36/38 X |
| 553,128 | 1/1896 | McDonald | 36/38 |
| 1,021,142 | 3/1912 | Freeman | 36/7.6 X |
| 1,160,756 | 11/1915 | Randall | 36/38 |
| 2,508,318 | 5/1950 | Wallach | 36/38 |
| 2,545,519 | 3/1951 | Kells | 36/38 |
| 2,555,654 | 6/1951 | Ostrom | 36/38 |

*Primary Examiner*—Alfred R. Guest
*Attorney, Agent, or Firm*—George B. White

[57] ABSTRACT

In the heel of a shoe is a cavity in which the end of a leaf spring is coiled around and anchored in a fixed pin biased so that the leaf spring is normally urged away from the adjacent portion of the heel. The leaf spring is at an incline downwardly and rearwardly along an inclined bottom surface of the heel and has on it a complemental portion of the heel. The leaf spring is held against said inclined surface by a pivoted lever which latter is pressed by a coil spring around its pivot against the leaf spring thereby to press the leaf spring against the inclined surface of the heel. The lever is covered by a complemental heel portion. Between the lever and the adjacent forward part of the heel is a compressible filler which in this illustration is sponge rubber to fill the space therewith. A latching device is provided in the cavity to latch the lever in the raised position until the leaf spring has completed its downward cycle. A release device in the cavity connected to the leaf spring is provided to release the latching device when the leaf spring is in its downstroke.

8 Claims, 5 Drawing Figures

SPRING LIFT FOR SHOES

BACKGROUND OF THE INVENTION

Applicant is aware of several spring devices in the heels or on the soles of shoes for various purposes such as Kells U.S. Pat. No. 2,545,419; Wallach U.S. Pat. No. 2,508,318; and also U.S. Pat. No. 2,555,654; U.S. Pat. No. 413,693; U.S. Pat. No. 1,021,142, and U.S. Pat. No. 1,160,756.

The primary object of this invention is that when the person puts his weight on the heel then a leaf spring is freed to exert force against the ground and thereby assist in the raising of the heel as the weight of the person is shifted toward the sole, means being provided to return the leaf spring to the initial position when the lift is completed. Another object of the invention is to provide such a device for assisting in the lifting of the heel which is compactly arranged in a cavity of the heel.

DETAILED DESCRIPTION

Figure 1:
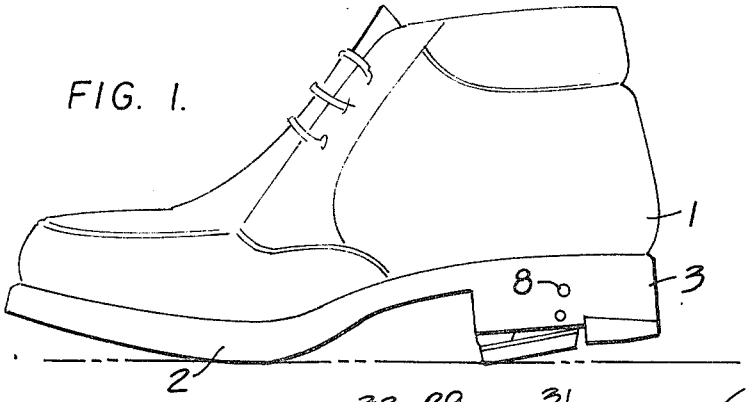
FIG. 1 is a side view of a shoe showing the heel in position before the weight of the person is shifted to the heel of the shoe, the leaf spring being held retracted.

The shoe 1 has a sole 2 and a heel 3. The heel has a cavity 4 therein. A bottom portion of the heel from the cavity toward the rear 6 of the heel is cut away to form a downwardly and rearwardly inclined surface 7. An anchor pin 8 is extended across the cavity 4 transversly of the heel. A spring coil 9 is anchored on the pin 8. A leaf spring 11 extends from the spring coil 9 so biased as to urge the leaf spring 11 away from the inclined surface 7. A complemental heel portion 12 on the leaf spring 11 complements the heel from the inclined surface 7 to its bottom level.

Figure 2:
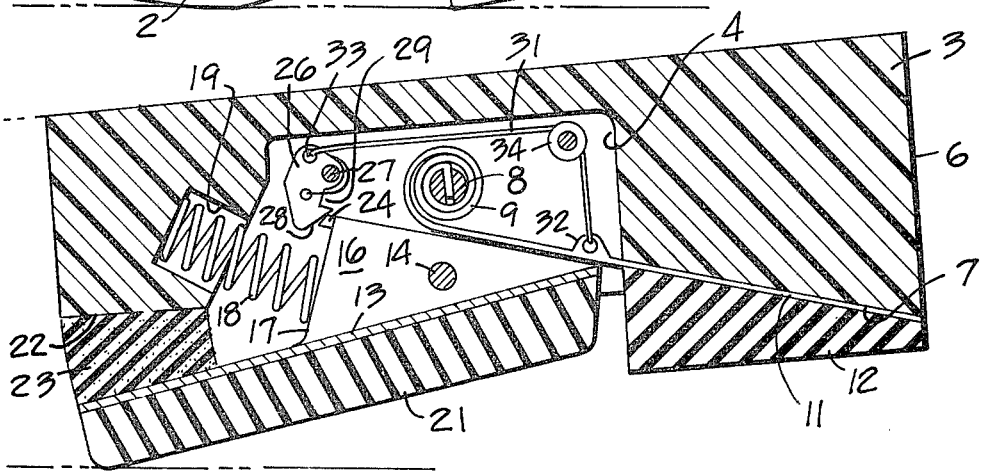
FIG. 2 is a cross-sectional view showing the heel lift in retracted position.
Figure 3:
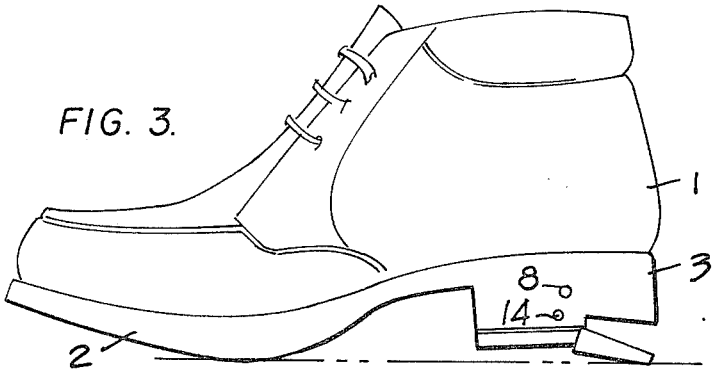
FIG. 3 is a side view showing the heel lift in the extended position.

A lever 13 is pivoted on a pin 14 which latter covers the cavity 4 below the anchor pin 8. The pivot pin 14 extends through a boss 16 on the lever 13, bearing face 17 of the boss 16 is engaged by a coil spring 18. The incline of the bearing face 17 and the bias of the coil spring 18 is such as to urge the lever 13 around the pivot 14 against the leaf spring 11 thereby to hold the leaf spring 11 against the inclined heel surface 7, as shown in FIG. 2. The coil spring 18 is nested in a pocket 19 in the side of the cavity 4 opposite the bearing face 17. The lever 13 has thereon a complemental heel strip 21. The forward end of the lever 13 is spaced from the adjacent bottom wall 22 of the heel by a compressible filler 23, such as sponge rubber.

A releasible latching device for the lever 13 includes a finger 24 which extends from the inner end of the bearing face 17 near the top of the boss 16. A pawl 26 is pivoted on a spring pivot 27 and is normally urged by the spring pivot 27 toward the finger 24. The lower face 28 of the pawl 26 forms a cam surface which initially is abutted by the finger 24 as shown in FIG. 2. When the lever 13 is rc ted in a clockwise direction viewing FIG. 2 into the position shown in FIG. 4 the finger 24 bears on the cam surface 28 and pushes the pawl 26 away and enters into a keeper recess 29 thereby to be locked in it and hold the lever 13 temporarily in the leaf spring releasing position.

Figure 4:
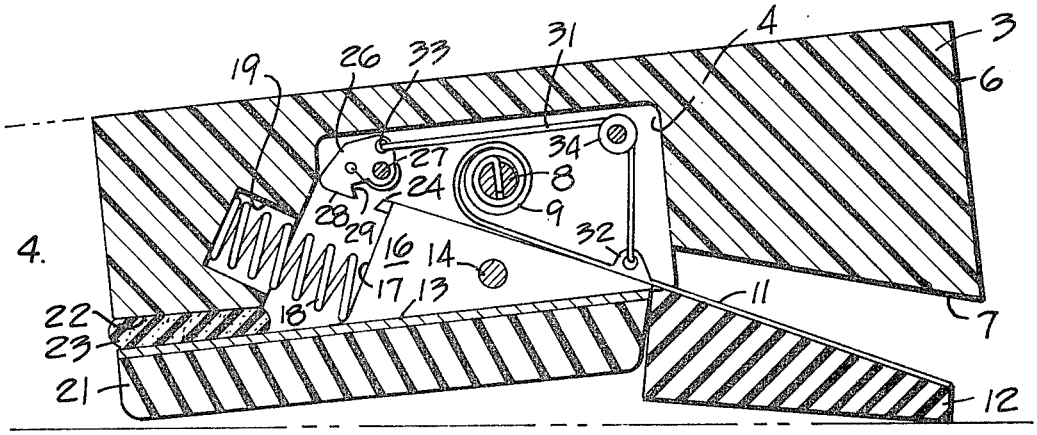
Figure 5:
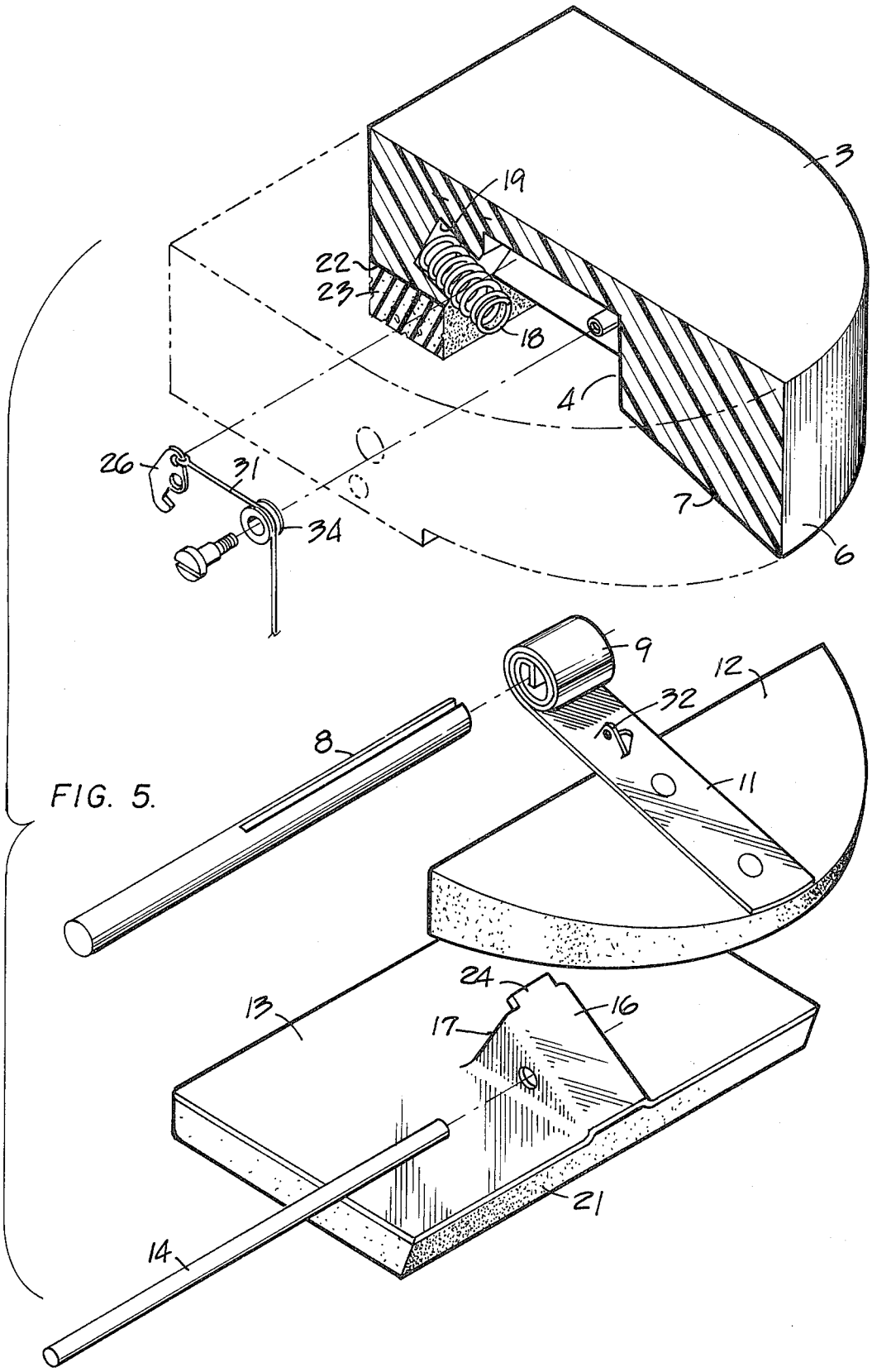
FIG. 5 is a developed view of the parts of the heel lift on the heel.

As the leaf spring 11 is released and moves from the position shown in FIG. 2 into the position shown in FIG. 4, thereby to aid in lifting the heel, a releasing mechanism pulls the pawl 26 around the spring pivot 27 so as to release the finger 24 thereby to allow the coil spring 18 to return the lever 13 into the initial locking position shown in FIG. 2.

The release mechanism includes a line 31 one end of which is secured to an ear 32 on the leaf spring 11 the other end of which is secured in a hole 33 of the pawl 26 above the spring pivot 27. The line 31 is played around a guide pulley 34 in the cavity 4. When the leaf spring 11 moves toward the position shown in FIG. 4, the line 31 is pulled downward and rocks the pawl 26 away from the finger 24 and releases the lever 13 which allows the coil spring 18 to return the lever 13 to its initial position bearing against the leaf spring 11. For this purpose the coil spring 18 is considerably stronger than the spring coil 9 of the leaf spring 11 so that the leaf spring 11 can move away from the slanted surface 7 only when the person places his weight on the forward portion of the heel thereby to rock the lever 13 into the position shown in FIG. 4.

I claim:

1. A lifting device for a heel, having a bottom, a first movable heel portion on said bottom, a second movable heel portion on said bottom, said heel portions complementing the bottom of the heel, first resilient mounting means related to said first movable heel portion biased to urge said first movable heel portion away from said bottom thereby to aid the lifting of the heel, second resilient mounting means related to said second movable heel portion and related to said first movable heel portion so as to initially urge said second movable heel portion to resist the bias of said first resilient mounting means and to urge said first movable heel portion toward said bottom, latching means on said heel actuated by movement of said second movable heel portion under pressure of weight on the heel so as to render said second resilient mount means inoperative, and releasing means on said heel actuated by the downward movement of said first heel portion to release said latching means, thereby to release said second resilient means for urging said first heel portion toward said bottom.

2. The lifting device for a heel specified in claim 1, and said first resilient mounting means including a pivotal support for said first movable heel portion, and said first movable heel portion being pivotably movable about said pivotal support.

3. The heel lifting device specified in claim 1, and said seocnd resilient mounting means including a pivot support for said second complemental heel portion.

4. The heel lifting device specified in claim 1, and said first resilient mounting means including a leaf spring anchored in said heel, so as to urge said first movable heel portion away from said bottom.

5. The lifting device specified in claim 4, and second resilient mounting means including a pivoted lever pivoted in said heel, and a spring stronger than said leaf spring urging said second pivoted heel portion toward said bottom and against the action of said leaf spring.

6. The heel lifting device specified in claim 1 and, said heel having a cavity therein, an inclined bottom surface of said heel extending from said cavity toward the rear of the heel, said first complemental heel portion being complemental and engaged with said inclined surface, said first resilient mounting means being mounted in said cavity to support said first movable heel portion in abutment with said inclined surface, said second resilient mounting means including a pivot support in said cavity and on said second movable heel portion, said second resilient mounting means urging said second movable heel portion about said pivotal mounting against said first resilient mounting means to resist the action of the latter.

7. The heel lifting device specified in claim 1, and said heel having a cavity therein, an inclined surface of said bottom extending from said cavity toward the rear of the heel, an inclined surface on said complemental heel portion abutting said inclined surface, said first resilient mounting means including a spring anchored in said cavity and connected to said first movable heel portion so as to normally urge said first movable heel portion away from said inclined surface, said second resilient mounting means including a mounting pivot in said cavity for pivotally supporting said second movable heel portion, a second spring bearing against said second movable heel portion so as to urge said second movable heel portion toward said bottom and into engagement with a part of said first movable heel portion, said second spring being stronger than said first spring so as to resist the action of said first spring.

8. The heel lifting device specified in claim 7, and said first spring being a leaf spring urging said first movable heel portion toward said inclined surface, said latching means including an element extended from said second movable heel portion into said cavity, a pawl resiliently pivoted in said cavity engageable with said element when said second movable heel portion is pressed inwardly of said cavity, so as to free said first movable heel portion, and said releasing means including a connecting element between said pawl and said leaf spring for turning said pawl for releasing said first element when said first movable heel portion is extended away from said inclined surface.

* * * * *